US008022840B2

(12) United States Patent
Camwell et al.

(10) Patent No.: US 8,022,840 B2
(45) Date of Patent: Sep. 20, 2011

(54) TELEMETRY TRANSMITTER OPTIMIZATION USING TIME DOMAIN REFLECTOMETRY

(75) Inventors: Paul L. Camwell, Calgary (CA); James M. Neff, Okotoks (CA)

(73) Assignee: XACT Downhole Telemetry Inc., Calgary, Alberta (CA)

( * ) Notice: Subject to any disclaimer, the term of this patent is extended or adjusted under 35 U.S.C. 154(b) by 0 days.

(21) Appl. No.: 12/878,858

(22) Filed: Sep. 9, 2010

(65) Prior Publication Data

US 2011/0006910 A1 Jan. 13, 2011

Related U.S. Application Data

(62) Division of application No. 11/786,645, filed on Apr. 11, 2007, now Pat. No. 7,817,061.

(60) Provisional application No. 60/790,774, filed on Apr. 11, 2006.

(51) Int. Cl.
*G01V 3/00* (2006.01)

(52) U.S. Cl. .... 340/854.4; 367/82; 367/83; 166/250.01; 702/17; 175/40

(58) Field of Classification Search ..... 340/854.4; 367/82–83; 702/17; 166/250.01; 175/40
See application file for complete search history.

(56) References Cited

U.S. PATENT DOCUMENTS

| | | | |
|---|---|---|---|
| 4,293,936 | A | 10/1981 | Cox et al. |
| 5,128,901 | A | 7/1992 | Drumheller |
| 6,023,658 | A | 2/2000 | Jeffryes |
| 6,152,246 | A | 11/2000 | King et al. |
| 6,434,084 | B1 | 8/2002 | Schultz |
| 6,909,667 | B2 | 6/2005 | Shah et al. |
| 6,933,856 | B2 | 8/2005 | Schultz |
| 6,940,420 | B2 | 9/2005 | Jenkins |
| 6,968,909 | B2 | 11/2005 | Aldred et al. |
| 7,163,065 | B2 | 1/2007 | Zhang et al. |
| 7,508,734 | B2 | 3/2009 | Fink et al. |
| 2005/0274513 | A1 | 12/2005 | Schultz et al. |

OTHER PUBLICATIONS

Drumheller, Douglas S., "Acoustical Properties of Drill Strings," *Jnl of the Acous. Soc. of Am.*, 85(3), Mar. 1989.

Bedford et al., "An Introduction to Elastic Wave Propagation," John Wiley & Sons, Inc., Mar. 1996.

*Primary Examiner* — Albert Wong

(74) *Attorney, Agent, or Firm* — Klarquist Sparkman, LLP

(57) ABSTRACT

A method for enhancing downhole telemetry performance comprising enhancing a signal in order to offset signal-to-noise ratio reduction with increasing measured depth, wherein the signal is modified at specified measured depths which are inferred from acoustic wave velocity determination.

2 Claims, 3 Drawing Sheets

TELEMETRY TRANSMITTER OPTIMIZATION USING TIME DOMAIN REFLECTOMETRY

CROSS REFERENCE TO RELATED APPLICATION

The present application is a divisional application of U.S. application No. 11/786,645, filed Apr. 11, 2007, now U.S. Pat. No. 7,817,061, which claims the benefit of U.S. Provisional Application No. 60/790,774, filed on Apr. 11, 2006, both of which applications are incorporated herein by reference.

FIELD

The present invention relates to telemetry apparatus and methods, and more particularly to telemetry apparatus and methods used in the oil and gas industry.

BACKGROUND

There are numerous methods, techniques and innovations designed to improve the oil and gas drilling process. Many of these involve feedback of various measured downhole parameters that are communicated to the surface to enable the driller to more efficiently, safely or economically drill the well. For example, U.S. Pat. No. 6,968,909 to Aldred et al. teaches a control system that combines measurement of downhole conditions with certain aspects of the operation of the drillstring. These downhole measurements are conveyed to the surface by well-known standard telemetry methods where they are used to update a surface equipment control system that then changes operation parameters. Closed loop two-way communication techniques like this, however, rely on the adequate detection at the surface of the telemetered parameters.

It is standard in the drilling industry to control certain parameters of the downhole telemetry transmitter by downlinking appropriate commands from the surface. For example, changing the downhole drilling fluid pressure in a prescribed manner by changing the flow rate of the drilling fluid and subsequently monitoring this by a downhole pressure gauge is a common technique. Problems associated with this and similar downlinking techniques include false detection, slowing of the drilling process and the need to include human intervention in the process.

There are at present two standard telemetry techniques in common use—data conveyed via pressure waves in the drilling fluid and data conveyed via very low frequency electromagnetic waves, both originating at a downhole transmitter. Another telemetry technique beginning to emerge in the drilling arena is to convey the data via acoustic waves travelling along the drillpipe within certain bands of frequencies (or passbands). All three technologies suffer from noise associated with the drilling operation, and all three similarly suffer signal attenuation at the surface as the well bore increases in length.

The design of acoustic systems for static production wells has been reasonably successful, as each system can be modified within economic constraints to suit these relatively long-lived applications. The application of acoustic telemetry for data transfer from downhole to an acoustic receiver rig at the surface in real-time drilling situations, however, is less widespread. Acoustic telemetry is an emerging technology and has as-yet unresolved problems related to the increased in-band noise due to certain drilling operations, and unwanted acoustic wave reflections associated with downhole components such as the bottom-hole assembly (or "BHA"), typically attached to the end of the drillstring. The problem of communication through drillpipe is further complicated by the fact that drillpipe has heavier tool joints than production tubing, resulting in broader stopbands; this entails relatively less available acoustic passband spectrum, making the problems of noise and signal distortion even more severe. As the well is drilled and the amount of drillpipe increases there is a general degradation of the available acoustic passband properties, primarily through two effects: the non-identical dimensions of the drillpipes due to manufacturing tolerances and recuts of tool joints (these will narrow and distort the acoustic passband); the acoustic signal attenuation increases directly with the number of drillpipes. The amount of drillpipe is directly related to the 'measured depth' (MD), in contrast to the 'true vertical depth' (TVD). TVD is the vertical depth used to calculate hydrostatic pressure.

Attenuation is also a function of the amount of wall contact with the drillpipe because this contact provides a means of extracting energy from acoustic waves travelling along the pipe. Typical attenuation values may range from 12 dB to 35 dB per kilometre.

Noise from many sources must also be dealt with. For example, the drill bit, mud motor and the BHA and pipe all create acoustic noise, particularly when drilling. The downhole noise amplitude generally increases as rotation speed of the drillpipe and/or the drilling rate of penetration increases. On the surface, noise originates from virtually all moving parts of the rig. Dominant noise sources include diesel generators, rotary tables, top drives, pumps and centrifuges.

Thus, it is evident that channel issues and noise problems will increase with the measured depth, drilling rate and rotary speed.

In summary, the challenges to be met for acoustic telemetry in drilling wells include:

- Restricted channel bandwidth due to the drillstring passband structure
- Channel centre shifts
- Dynamically changing channel properties
- Downhole noise due to drillpipe movements
- Downhole noise due to mud motor and/or drill bit activity
- Surface noise due to rig components such as diesel generators, rotating tables, and top drives

SUMMARY

It is an object of the present invention to improve telemetry transmission in a subsurface-to-surface telemetry link from a downhole transmitter to a receiver located at the surface rig.

According to one aspect of the invention, there is provided a method and apparatus for enhancing downhole telemetry performance. The method comprises: generating a signal from a downhole transmitter such that at least part of the signal propagates up a drillpipe and reflects at a terminus in the vicinity of the surface; receiving a reflection of the generated signal at a downhole receiver; applying time domain reflectometry to determine a measured depth from the time taken to generate and receive the signal; and modifying a downhole telemetry signal at specified measured depths in order to offset signal-to-noise ratio reduction with increasing measured depth. The apparatus comprises a downhole transmitter operable to generate a signal such that at least part of the signal propagates up a drillpipe and reflects at a terminus in the vicinity of the surface; a downhole receiver operable to receive a reflection of the generated signal; and a processor with a memory having recorded thereon steps and instructions for performing the steps of applying time domain reflectometry and modifying a downhole telemetry signal in the above method.

The telemetry signal can be modified by modifying one or more of signal repetition, signal length, signal frequency span, transmission output level.

The signal can be an acoustic energy pulse. In such case, the energy pulse can comprise a plurality of chirps. The receiver in such case can be an accelerometer. Alternatively, the signal can be a pressure pulse generated by a mud pulse generator. The receiver in such case can be a microphone or a pressure transducer. In either case, the transmitter and receiver can be located in a repeater, or in a transceiver that is associated with a bottom hole assembly.

The method can further comprise generating a second signal with at least one different characteristic than a previously generated signal when the downhole receiver does not receive the reflection of the previously generated signal. This characteristic can be one or more of output level, chirp duration, chirp number, and chirp pattern. Alternatively, the method can further comprise receiving multiple reflections of the generated signal and selecting the reflection having the longest time for determination of the measured depth.

According to another aspect of the invention, there is provided another method and apparatus for enhancing downhole telemetry performance. The method comprises: generating a signal from a downhole transmitter such that at least part of the signal propagates up a drilipipe and reflects at a terminus in the vicinity of the surface; receiving a reflection of the generated signal at a downhole receiver; determining a signal to noise ratio by comparing the ratio of the generated signal and reflection magnitudes; and modifying a downhole telemetry signal in response to the determined signal-to-noise ratio. The apparatus comprises: a downhole transmitter operable to generate a signal such that at least part of the signal propagates up a drilipipe and reflects at a terminus in the vicinity of the surface; a downhole receiver operable to receive a reflection of the generated signal; and a processor with a memory having recorded thereon steps and instructions for carrying out the steps of determining a signal-to-noise ratio and modifying the downhole telemetry signal of the method.

A further benefit of the present invention is the likelihood of improved battery life. This can occur because the downhole tool can be initially configured to transmit in its lowest power mode, and only increase power as the technique assesses the need to increase the surface SNR via the various means discussed further herein as the well is drilled and MD is increased. There are other related power-saving scenarios that would be obvious to one skilled in the art.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The following drawings illustrate the principles of the present invention and exemplary embodiments thereof.

DETAILED DESCRIPTION

Signal-to-noise ratio (SNR) is a metric that may be used to monitor and assess the quality or performance of a telemetry signal. Telemetry performance may be defined as the ability of the surface receiver to decode the telemetered parameters detected at surface in the presence of noise. Maximizing the SNR is of key importance in telemetry. Aspects of the present embodiments provide methods for automatic control of transmitter or transceiver parameters so as to maintain the SNR at a suitable threshold. Time-delay reflectometry has been described employing electrical or optical pulses to monitor downhole conditions during operations such as gravel or fracture packing, and the calculations themselves are well-known to those of skill in the art (see, for example, For example, U.S. Patent Application Publication No. US2005/0274513 to Schultz et al.). Applying such methods in real time, to a wellbore while drilling, places additional demands on both the equipment and on the signal quality required.

Figure 1:
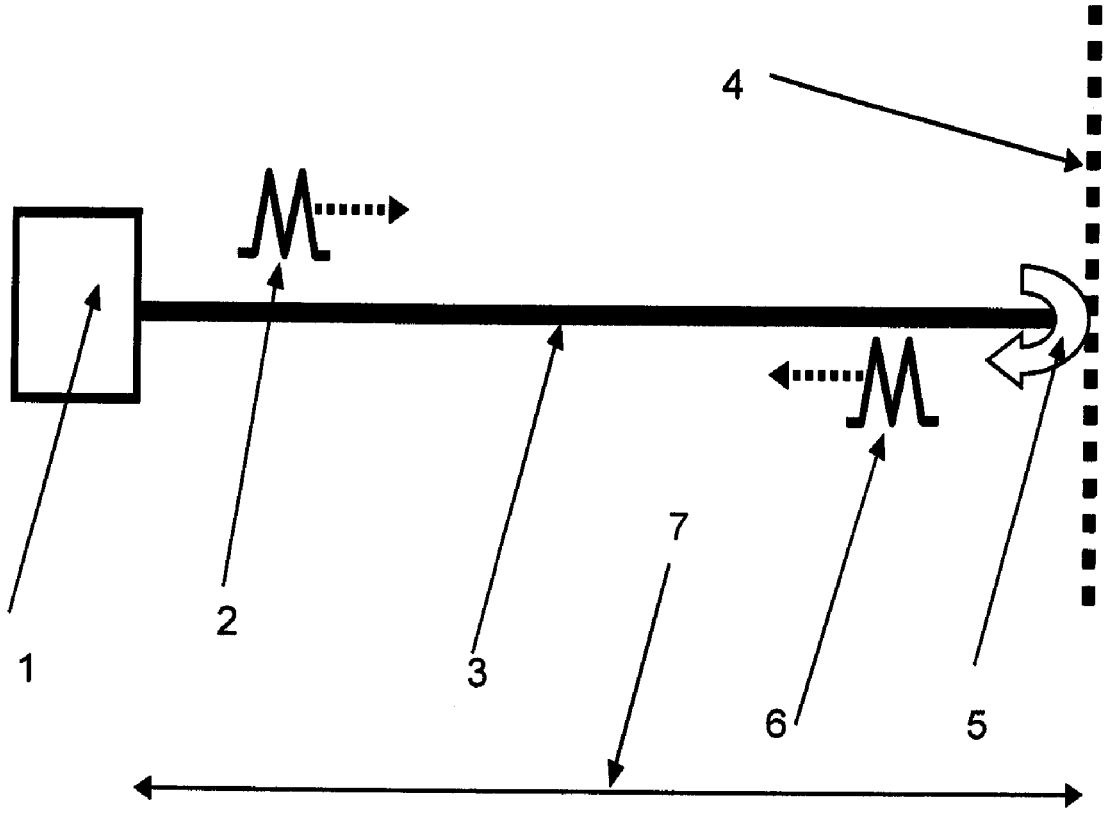
FIG. 1 is a schematic view of a system comprising a source initially emitting a signal along a channel, and the signal is later seen reflecting at the far end of the channel, finally returning to a receiver associated with the source in order that its time-of-flight may be measured.

Referring to FIG. 1 and according to one embodiment of the invention, a time domain reflectometry (TDR) system is generally shown. A transmitter/receiver device 1 is used to initially launch an acoustic energy pulse 2 (chirp or otherwise) along a drillpipe 3. This pulse encounters a major reflection at the end of the drillpipe 4 where it reflects at location 5 and proceeds back along the drillpipe 3. The phase of the reflected pulse 6 relative to the incident pulse 2 may be dependent on the reflecting surface, i.e., if the surface comprises a rigid or an open boundary. The drillpipe length L7 and the average speed of sound in the drillpipe 3 determine the time T it takes for the pulse to return to the transmitter/receiver device 1, as would be determined by equation 1:

$$T=2L/V \quad [1]$$

wherein

L is the length of the drillpipe from the device 1 to the reflection location V is the velocity of the acoustic energy pulse along the drill pipe (speed of sound)

Equation 1 can be manipulated to determine L:

$$L=T\times V/2 \quad [2]$$

If the length of the drillpipe 7 is unknown, equation 2 can be used to determine the length 7 by measuring the time taken to reflect the acoustic pulse (assuming the velocity of the pulse is known).

Figure 2:
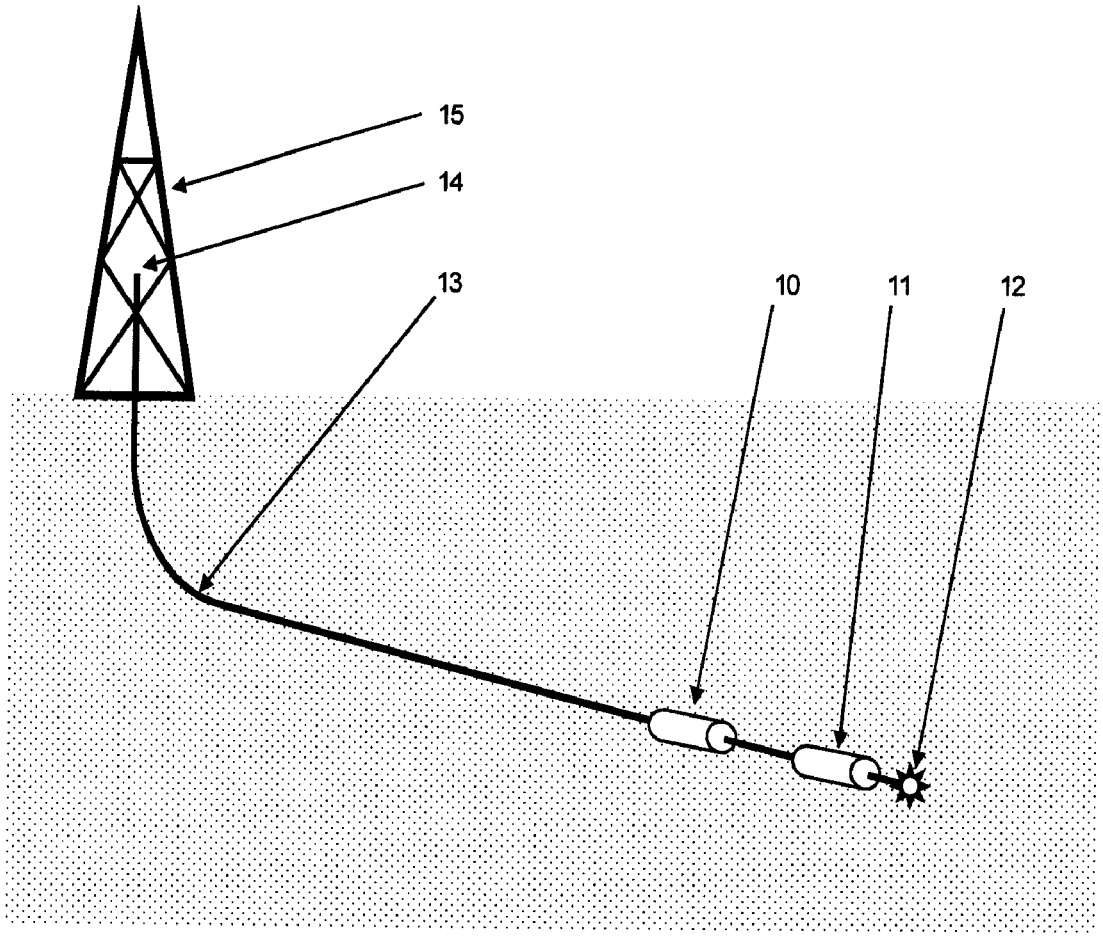
FIG. 2 is a schematic view of the system of FIG. 1 applied to a rig and a downhole tool, the channel being the drillpipe between the tool and the termination of the pipe at the rig.

Referring now to FIG. 2, there is provided methods for enhancing the signal received at a rig 15, in order to offset the reduction in SNR as the MD increases. Enhancing the signal may be accomplished by implementing one or more of the following exemplary transmission enhancement actions, which are for illustrative purposes only:

signal repetition
increased signal length
increase the signal's frequency span
increase the transmitter's output level Other modifications to the signal that may be appropriate will also be apparent to those of skill in the art.

In one example, the transceiver 10 output level may be increased to compensate for the increasing distance. In order to conserve the transceiver 10 battery power and minimize the echo interference, this power increase may be only at an 'as needed' level, To determine this 'as needed' level, the transceiver 10 may use information relating to the MD of the drillpipe to alter the transceiver output accordingly. In a one-way telemetry system, the downhole components may not be in receipt of this information from the surface, and an inferential method may be used. An approximation of MD may be obtained by measuring the time of flight of an acoustic wave (a 'chirp') initiated at a downhole end of the drillstring. The downhole tool in one particular embodiment uses an acoustic telemetry means by which it communicates along the drill pipe.

A chirp (comprising a few tens of cycles) having a fundamental or average frequency matching that of at least one of the passbands inherent in a series of drillpipe is emitted by the transceiver 10 and transmitted along the drillstring. Passband frequencies are described elsewhere in the art, for example, Bedford and Drumheller, *An Introduction to Elastic Wave Propagation,* John Wiley and Sons, 1994; and U.S. Pat. No. 5,128,901 to Drumheller.

The chirp may undergo partial reflections at mechanical discontinuities along the drillstring, with the remainder of the chirp signal energy continuing in the original direction of travel. The residual chirp energy will encounter a significant discontinuity with a known location where the drillstring ended at the kelly on the rig (or at another surface termination of a drill string). At this point, the chirp would reflect and return to the transceiver 10. On the return path it would also suffer reflections and similar attenuation, in a similar manner as per the uphole travel. The returning wave train of the chirp is subsequently detected at the transceiver 10. In an alternate embodiment where the transmitted chirp is an acoustic signal, the transceiver would comprise an acoustic detector (for example an accelerometer) to detect this returning wave-train, if it was of sufficient magnitude. If the returning wave-train is not detected after a period of time, the transceiver 10 would repeat the chirp at a higher power output, and monitor for the returning wave-train as before.

As the Kelly of the rig 15 is the reflection location of the chirp, the distance between the transceiver 10 and the rig 15 is the length of the drillpipe, i.e., the measured depth (MD). Therefore, the length L in equation 1 can be replaced by MD to determine the time taken for the chirp to travel the MD and back:

$$T=2\,MD/Vg \qquad [1(a)]$$

wherein Vg is the group velocity of the chirps.
Equation 1(*a*) can be solved for MD:

$$MD=T\times Vg/2 \qquad [2(a)]$$

A time gating procedure that excludes the initial pulse, and many of the close-by reflections may also be applied to this determination. It may be preferable to consider for the purposes of determination of MD only the echo that matched the longest round-trip time T, as this would be a result of the reflection event at the surface drillstring termination at the rig. If multiple round-trip reflections were to occur, such as 2T, 4T, etc., these may be ignored by a logic gate.

An acoustic tool deployed as a TDR, therefore provides a method to assess MD (to within a few tens of meters, as shown by actual results). The transceiver 10, if programmed with a 'look-up' table for correlating MD increments with an increase in transceiver power output, may respond to the changing SNR due to attenuation or other losses of signal by increasing power output accordingly.

In a simplified situation, for example, for every 500 m of MD, transceiver output may be increased 15%. One of skill in the art will readily recognize however, that an arbitrary increase of, for example 15% may not overcome an SNR below a threshold value for every situation. The transceiver may subsequently repeat the chirp and response series of steps as described above, or alternately, the transceiver may be pre-programmed with a different power increase response, dependent on the power source available (battery vs mud motor or other power source) and other downhole conditions.

Distance is not the only source of signal attenuation or poor SNR in downhole telemetry, and increasing the transceiver power output is not the only solution available in the presence of a poor SNR ratio.

If a TDR first return echo is below the SNR system threshold, other methods may be employed to increase the magnitude, including increasing output level (as exemplified above), increasing the duration of the chirp and average the signal, increasing the number of chirps according to a particular pattern, and correlate the return signal to this pattern, and the like.

In an example where these methods, individually or in combination (depending on the design and capabilities of the transceiver) still do not suffice to improve the SNR of the returned chirp, the system may default to a maximum power condition. Periodic reassessment of the SNR of subsequent chirps may then be employed until rig drilling conditions returned to a more favourable circumstance, and the power output of the transceiver, magnitude of the chirp, etc readjusted accordingly.

By these and/or other methods, the TDR method could be implemented even whilst drilling, despite the increased noise.

As discussed above, an acoustic pulse or similar signal where the cyclic energy is substantially within one of the drillstring passbands is launched from acoustic transmitter/receiver (transceiver) 10. The pulse travels both up and down the drillpipe. The upward travelling energy comprises a small group of energy packets, which can be regarded as a single packet for ease of explanation. The upward travelling energy packet proceeds along the drillpipe until it encounters a major discontinuity at the rig 15, where it reflects from the free end (open boundary) and returns to the acoustic transceiver 10.

The downward travelling energy would encounter major reflecting surfaces such as the bottom hole assembly 11 and the drill bit 12 and reflect uphole, with varying degrees of scattering and/or attenuation. This returning or "reflecting" energy is not required for the purpose of measuring the approximate length 13 of the drillpipe between the acoustic transmitter/receiver 10 and the drillpipe termination 14 at the rig 15, but may introduce complexity by interfering with the signal transmitted uphole. The reflected energy associated with the bottom hole assembly 11 and the drill bit 12 would then travel through the transmitter/receiver 10, following the energy associated with the initial pulse emitter, toward the surface. To avoid confusion by measuring this reflected energy, methods comprising a time-gate procedure may be used. Examples of time-gate procedures are described in the art.

An echo at this uphole end of the drillstring may result. Known methods to address this echo are described in U.S. Pat. No. 5,128,901 to Drumheller.

Figure 3:
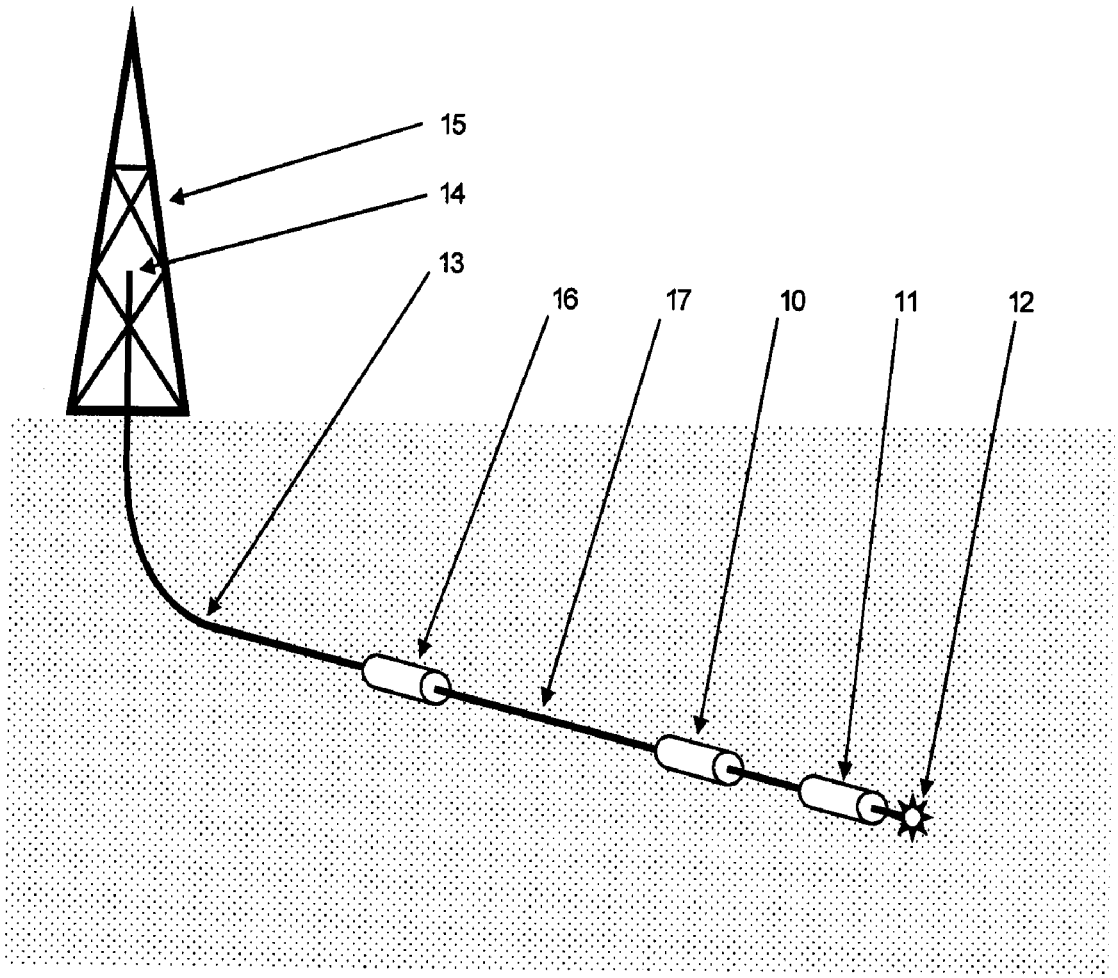
FIG. 3 is a schematic view of system shown in FIG. 2 wherein a repeater is incorporated in the downhole system.

Referring now to FIG. 3 and according to another embodiment, the drillstring shown in FIG. 2 incorporates a repeater section; repeater 16 and drillpipe section 17 is inserted in drill pipe 13 as shown. The TDR system can be applied to the repeater sub 16 as it did to acoustic transmitter/receiver 10. As the section 17 of drillpipe between transmitter/receiver 10 and repeater sub 16 is fixed, a TDR method may not need to be applied to this or other similar sections if more than one repeater is employed.

The noise sources affecting telemetry performance are dependent on the equipment operating, the geologic strata being drilled, and other factors involved in the drilling, as will be known to those of skill in the art. Signal attenuation will increase as the well is drilled deeper, moving the transceiver 10 further away from the receiver at the rig 15, and increasing the contact with the wall as more drillpipe is added to the drillstring.

In another embodiment of the invention, the ratio of the original transmission magnitude (first transmitted chirp) to the first echo magnitude may be used to assess the SNR of the telemetry. This ratio would encompass the entire 2-way signal attenuation, and thus may offset the need to associate inferred MD with a assumed attenuation—the transceiver tool would directly measure this and implement the appropriate change in SNR parameters. Furthermore, such changes could be implemented more dynamically.

In another embodiment of the invention, the system comprises a mud-pulse telemetry system. The downhole tool generates a sequence of pressure pulses that propagate preferentially within the drilling fluid in a similar manner as acoustic waves. The ultimate reflection would occur in the vicinity of the kelly hose and/or the pulsation dampeners and/or the drilling fluid surface pumps. With a sufficient transmitted amplitude or a long enough sequence of pressure pulses on which to correlate the echo may be detected in a manner similar to the acoustic wave-train. In such a mud pulse telemetry application using the above method, the detector may be, for example, a microphone or a pressure transducer. Factors affecting SNR in a mud-pulse telemetry system and methods of modifying a pressure pulse signal to compensate or overcome such factors will be known to those of skill in the art.

In another embodiment of the invention, a longer time chirp is initiated (comprising, for example, a few hundred cycles, but still within a chosen passband), such that this wave-train contained much more energy than a conventional chirp (typically a few tens of cycles). Using a standard de-spreading technique, such as is used in spread-spectrum communication systems, this is equivalent to propagating and detecting a large-amplitude, short duration, pulse. If the group velocity Vg of the short or de-spreaded chirp in drillpipe is about 3,900 m/s, a distance resolution of 100 m would require a time resolution of only 26 milliseconds, readily attainable with modern digital circuits.

Although various embodiments of the invention are disclosed herein, many adaptations and modifications may be made within the scope of the invention in accordance with the common general knowledge of those skilled in this art. Citation of references herein shall not be construed as an admission that such references are prior art to the present invention.

We claim:

1. A method for enhancing downhole telemetry performance comprising:

(a) generating a signal from a downhole transmitter such that at least part of the signal propagates up a drillpipe and reflects at a terminus in the vicinity of the surface;

(b) receiving a reflection of the generated signal at a downhole receiver;

(c) determining a signal to noise ratio by comparing the ratio of the generated signal and reflection magnitudes; and (d) modifying a downhole telemetry signal in response to the determined signal-to-noise ratio.

2. An apparatus for enhancing downhole telemetry performance comprising:

(a) a downhole transmitter operable to generate a signal such that at least part of the signal propagates up a drillpipe and reflects at a terminus in the vicinity of the surface;

(b) a downhole receiver operable to receive a reflection of the generated signal;

(c) a processor with a memory having recorded thereon steps and instructions for determining a signal to noise ratio by comparing the ratio of the generated signal and reflection magnitudes; and modifying a downhole telemetry signal in response to the determined signal-to-noise ratio.

* * * * *